US006837496B2

(12) United States Patent
Larson et al.

(10) Patent No.: US 6,837,496 B2
(45) Date of Patent: Jan. 4, 2005

(54) BULLET TRAPPING MEDIUM AND SYSTEM

(75) Inventors: Steven L. Larson, Vicksburg, MS (US); Charles A. Weiss, Clinton, MS (US); Joe G. Tom, Vicksburg, MS (US); Philip G. Malone, Vicksburg, MS (US); Edward J. Fransen, Irvine, CA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/307,427

(22) Filed: Dec. 2, 2002

(65) Prior Publication Data

US 2004/0104533 A1 Jun. 3, 2004

(51) Int. Cl.[7] ..... F41J 1/12
(52) U.S. Cl. ..... 273/410
(58) Field of Search ..... 273/403–410; 89/36.02; 528/484; 106/672

(56) References Cited

U.S. PATENT DOCUMENTS

| | | | | |
|---|---|---|---|---|
| 5,435,571 A | | 7/1995 | Wojcinski et al. | |
| 5,607,163 A | | 3/1997 | Nesler | |
| 5,848,794 A | | 12/1998 | Wojcinski et al. | |
| 5,901,960 A | | 5/1999 | Nesler et al. | |
| 6,000,700 A | | 12/1999 | Nesler et al. | |
| 6,027,120 A | | 2/2000 | Wojcinski et al. | |
| 6,173,956 B1 | | 1/2001 | O'Neal | |
| 6,264,735 B1 | * | 7/2001 | Bean et al. | 106/672 |
| 6,293,552 B1 | | 9/2001 | Wojcinski et al. | |
| 6,378,870 B1 | | 4/2002 | Sovine | |
| 6,446,974 B1 | * | 9/2002 | Malone et al. | 273/410 |
| 6,573,358 B2 | * | 6/2003 | Michels et al. | 528/489 |

FOREIGN PATENT DOCUMENTS

WO WO 91/17408 * 11/1991

* cited by examiner

*Primary Examiner*—Mark S. Graham
(74) *Attorney, Agent, or Firm*—Scott A. Felder

(57) ABSTRACT

A backstop for decelerating and trapping projectiles generally includes a support structure having an inclined surface and a projectile trapping medium disposed on the inclined surface. The projectile trapping medium may be either a resilient granular ballistic medium or a combination of a ballistic medium with a hydrated super absorbent polymer (SAP) gel. Preferably, the support structure is made of a shock absorbing, foamed, fiber-reinforced concrete, such as SACON®. In embodiments, the support structure also includes an enclosure. Additives may also be mixed into the projectile trapping medium to control alkalinity and prevent leaching of heavy metals.

18 Claims, 4 Drawing Sheets

BULLET TRAPPING MEDIUM AND SYSTEM

STATEMENT OF GOVERNMENT INTEREST

The invention described herein may be manufactured and used by or for the United States Government for governmental purposes without the payment of any royalties thereon.

BACKGROUND OF THE INVENTION

1. Field of the Invention

The present invention relates generally to the firing of projectiles on a range, and, more particularly, to an apparatus and method for decelerating and trapping munitions fired on a range.

2. Background Description

In order to maintain proficiency in the use of firearms, it is common to engage in target practice on a training range. Traditionally, the primary concern on a training range was the prevention of ricochets. Thus, ranges often use a large dirt berm behind the target to decelerate and trap the bullet.

More recently, however, considerable concern has been raised about the environmental impact of heavy metals (e.g., lead, tungsten, copper) contained within the bullet. Though a bullet fired into a mound of dirt is safely contained from the standpoint of no longer being a dangerous projectile, heavy metals within the bullet remain free to leach into the soil, thereby contaminating the environment. Thus, shooting ranges have begun to stress containment and removal of expended rounds in order to prevent environmental contamination.

Additionally, there is a growing desire to build shooting ranges within enclosed structures. This permits frequent use of the range regardless of weather and without excessive travel time. Obviously, however, use of a dirt berm behind the target is impractical for such indoor ranges.

Thus, current trends in bullet containment systems focus on two different types of systems. The first, often called a bullet stop and containment chamber, has a pair of plates that channel bullets toward an opening in a containment chamber. Inside the containment chamber are impact plates that slow the bullet to a stop. Unfortunately, such systems are relatively expensive and difficult to manufacture and maintain.

The second type of containment system is the bullet backstop or bullet trap system. Bullet backstops typically include a back plate made of steel inclined to the line of fire. On an upper surface of the back plate, a layer of material is disposed to provide a medium for decelerating and trapping bullets. This layer is several feet thick in the direction the bullet travels. The impact material is typically a resilient granular material. As a bullet impacts the material, it will decelerate sufficiently such that, if it does impact the back plate, any ricochet will be minimal.

A number of bullet traps utilize rubber chunks or chips as the impact material. For example, U.S. Pat. No. 6,378,870 to Sovine ("the '870 Patent") teaches the use of relatively large rubber nuggets disposed along a plane inclined to the line of fire, while U.S. Pat. No. 5,848,794 to Wojcinski et al. ("the '794 Patent") discloses a similar bullet trap using relatively small rubber granules disposed along an inclined plane. To reduce scatter and sluffing of the impact material, the '794 Patent further teaches the use of a self-healing membrane covering the rubber granules.

However, trapping systems like those disclosed in the '870 Patent and the '794 Patent lack inherent fire retardant characteristics. Thus, they often suffer from heat and fire problems, especially if the chips are not treated with a fire retardant, are improperly maintained, contain steel or fiber, or if the chips are relatively small. To combat these hazards, both the '870 Patent and the '974 Patent teach treating the rubber nuggets with a fire retardant. Unfortunately, the fire retardants used in these and other prior art systems tend to wash off, such that traps maintained outdoors will rapidly lose their fire retardant characteristics during and after a rain. Additionally, though these systems trap the bullet, they do nothing to stabilize them from an environmental hazard standpoint. Thus, expended rounds must periodically be recovered from the trap to prevent heavy metal leaching and associated environmental contamination.

SUMMARY OF THE INVENTION

Accordingly, it is an object of the present invention to provide a bullet trapping system with inherent flame retardant characteristics.

It is another object of the present invention to provide a bullet trapping system that substantially reduces the likelihood of ricochets.

Still another object of the present invention is to provide a bullet trapping system that will not leach heavy metals into the environment.

Yet another object of the present invention is to provide a bullet trapping system that can accommodate many different calibers and types of bullets.

A further object of the present invention is to provide a bullet trapping system that requires minimal maintenance over an extended useful life.

The present invention is a backstop for decelerating and trapping projectiles. The backstop generally includes a support structure having an inclined surface and a projectile trapping medium disposed on the inclined surface. The projectile trapping medium may be either a resilient granular ballistic medium, such as rubber chunks, plastic scrap, or wood chips, or a combination of a ballistic medium with a hydrated super absorbent polymer (SAP) gel. Preferably, the support structure is made of a shock absorbing, foamed, fiber-reinforced concrete, such as SACON®. In embodiments, the support structure also includes an enclosure. The enclosure includes a back wall and opposing sidewalls, and optionally includes a toe block adjacent to the foot of the inclined surface. Additives, such as phosphates, carbonates, silicates, bicarbonates, and hydroxides may also be included in the projectile trapping medium. These additives may serve to raise the pH of the SAP gel, prevent leaching of heavy metals from the projectile into the environment, stabilize the SAP gel chemically, act as a flame retardant, retard the growth of mold or bacteria in the SAP gel, or some combination thereof.

Further advantages of the present invention will be apparent from the description below with reference to the accompanying drawings, in which like numbers indicate like elements.

DETAILED DESCRIPTION OF PREFERRED EMBODIMENTS OF THE INVENTION

Figure 1:
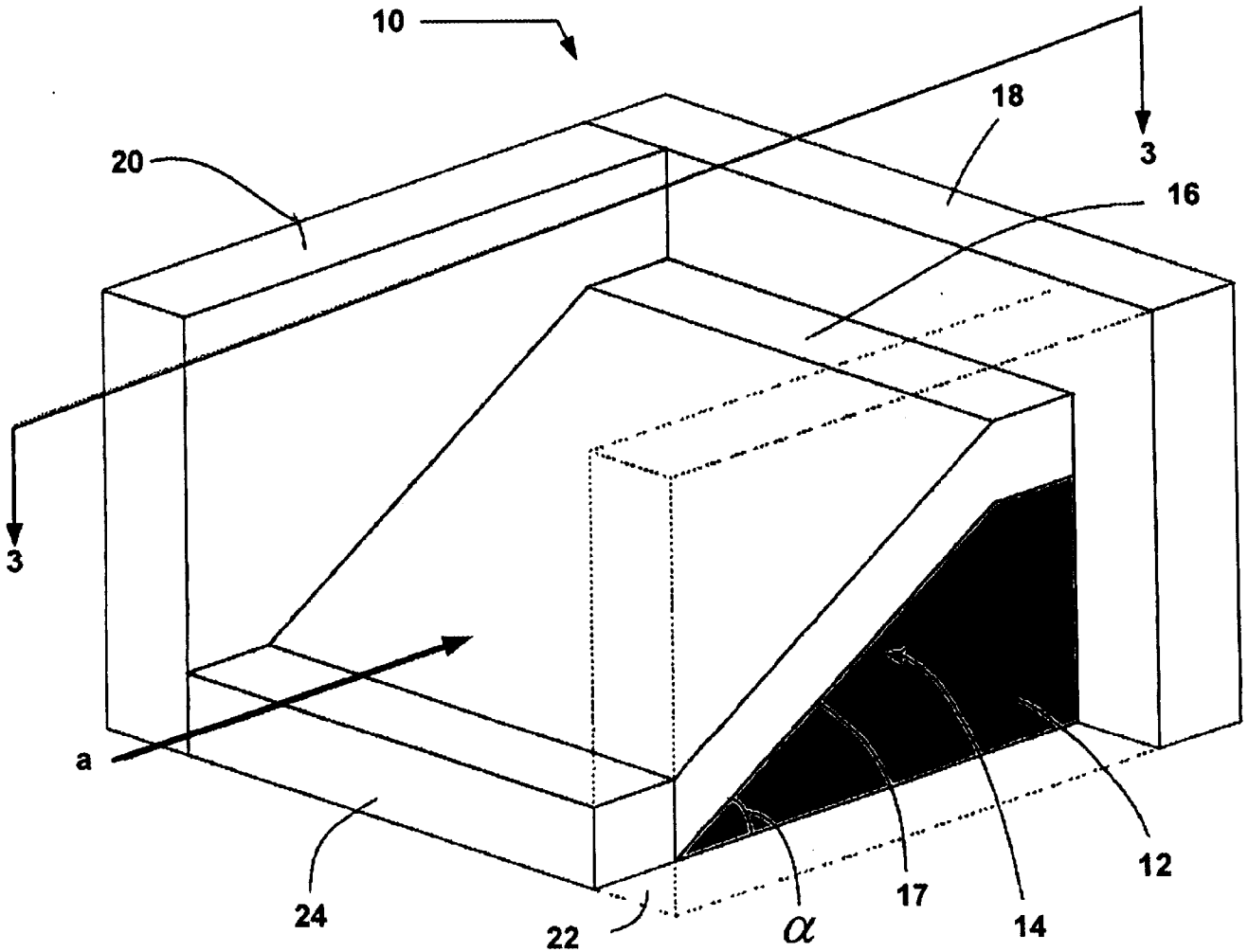
FIG. 1 is a perspective view of a bullet trapping backstop according to the present invention, with one sidewall shown in phantom for clarity.
Figure 2:
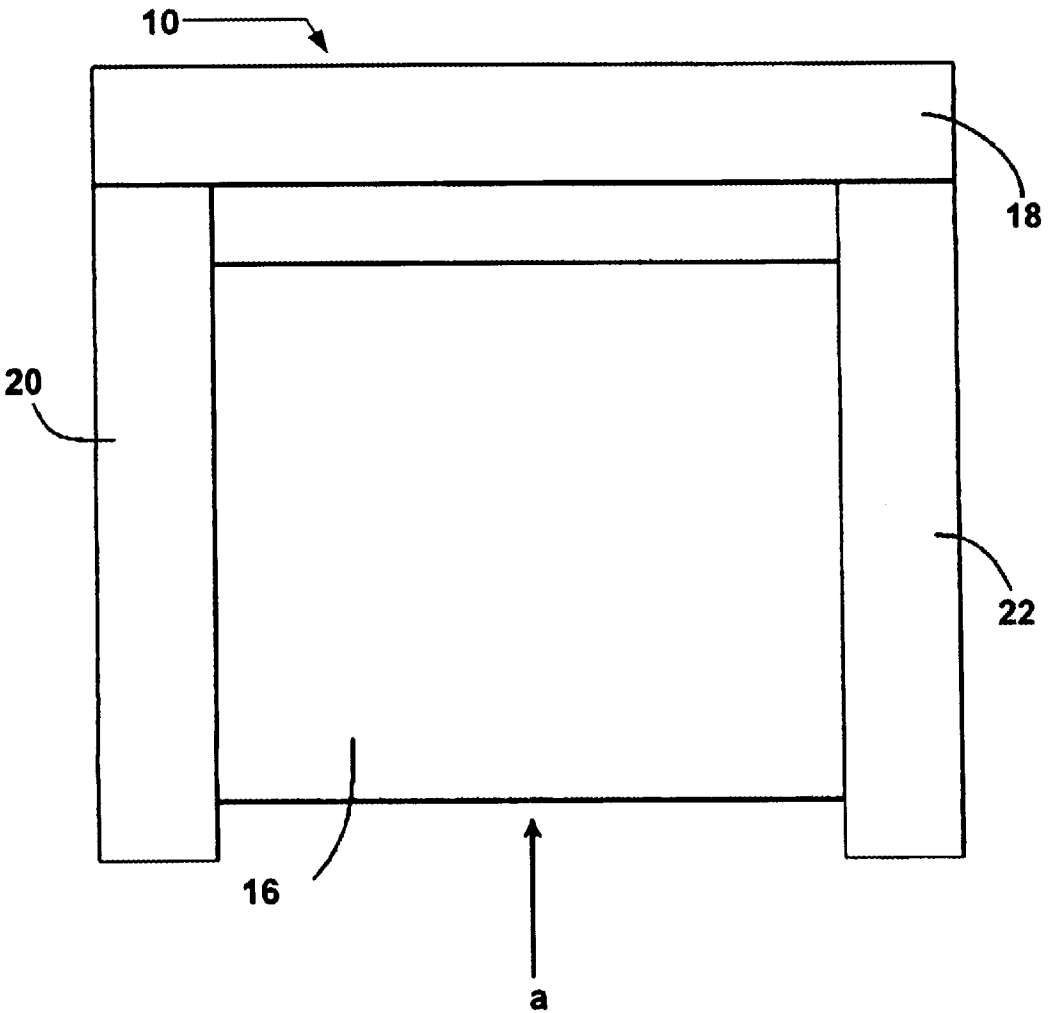
FIG. 2 is a partial top plan view of the bullet trapping backstop of FIG. 1.
Figure 3:
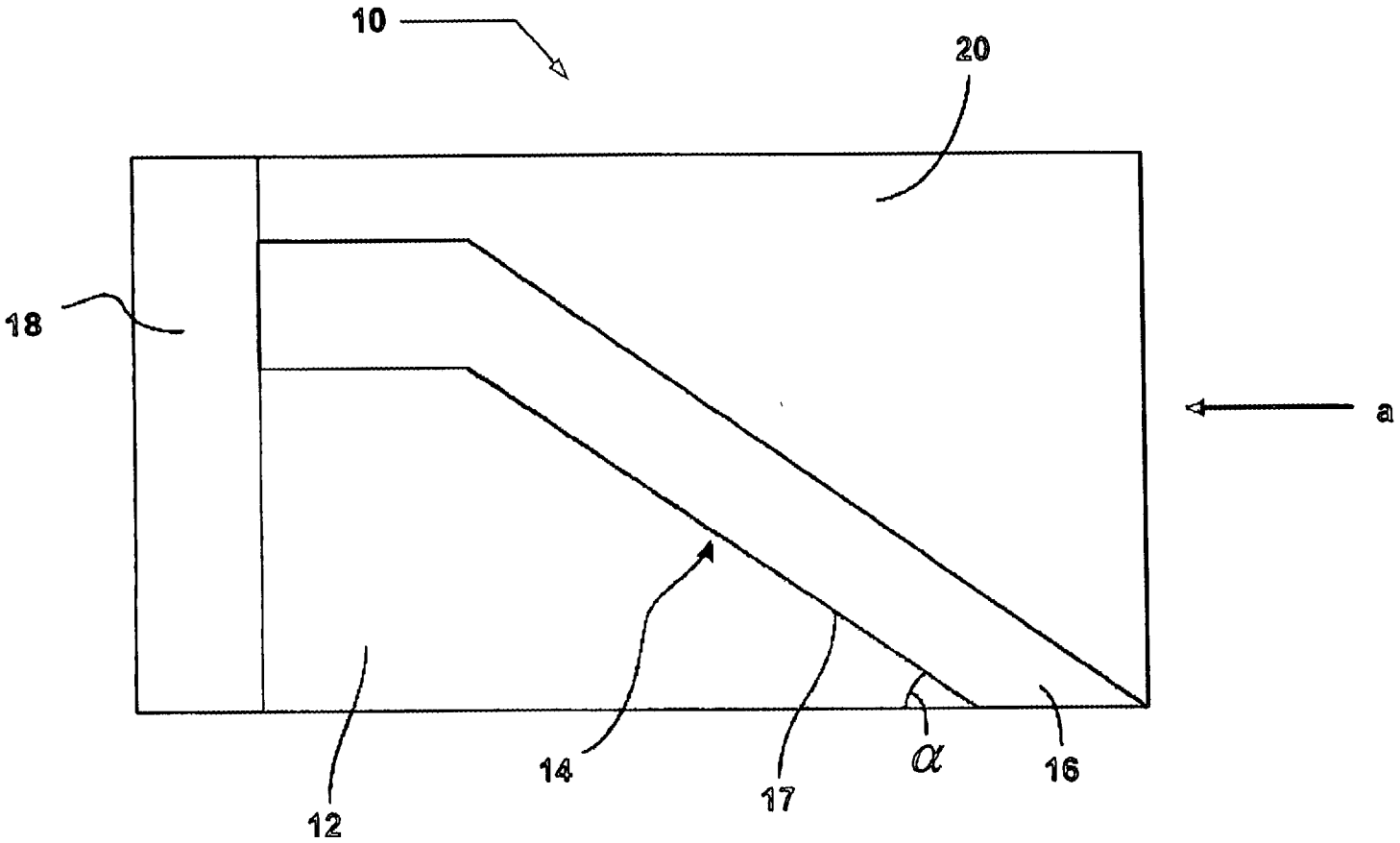
FIG. 3 is a cross-sectional side view of the bullet trapping backstop of FIG. 1, taken along line 3-3 with the optional toe block removed.

Referring now to the drawings, and specifically to FIGS. 1 through 3, there is shown a bullet trapping backstop 10 for decelerating and trapping projectiles traveling along a line of fire "a" towards backstop 10. (It should be understood that the terms "bullet," "projectile," and "round" are used interchangeably herein and refer to projectiles or munitions of any sort or caliber.) Backstop 10 generally includes a foundation or support structure 12 having an upper surface 14 and a projectile trapping medium 16 disposed on upper surface 14. FIG. 2 shows a plan view of upper surface 14 of bullet trapping backstop 10. At least a portion 17 of upper surface 14 is inclined with respect to line of fire "a" by an angle $\alpha$, which is preferably less than or equal to the angle of repose of projectile trapping medium 16. In embodiments, support structure 12 includes a back wall 18 and opposing first and second sidewalls 20, 22, forming an enclosure around projectile trapping medium 16. (In FIG. 1, second sidewall 22 is shown in phantom for clarity.) Support structure 12 may also include a toe block 24 disposed adjacent to the foot of the inclined portion 17 of upper surface 14. However, one skilled in the art will realize that, because angle $\alpha$ should not exceed the angle of repose of bullet trapping medium 16, toe block 24 is not required to hold bullet trapping medium 16 in place. This embodiment of backstop 10 is best illustrated in FIG. 3.

Preferably, support structure 12 (including back wall 18, first and second sidewalls 20, 22, and toe block 24 when present) is made of a shock absorbing, foamed, fiber-reinforced concrete, such as SACON®. Such construction reduces the likelihood of dangerous ricochets of any rounds that impact support structure 12 instead of bullet trapping medium 16. However, one skilled in the art will recognize that all or part of support structure 12 may also be made from any other appropriate material, such as wood, steel, or earth.

Figure 4:
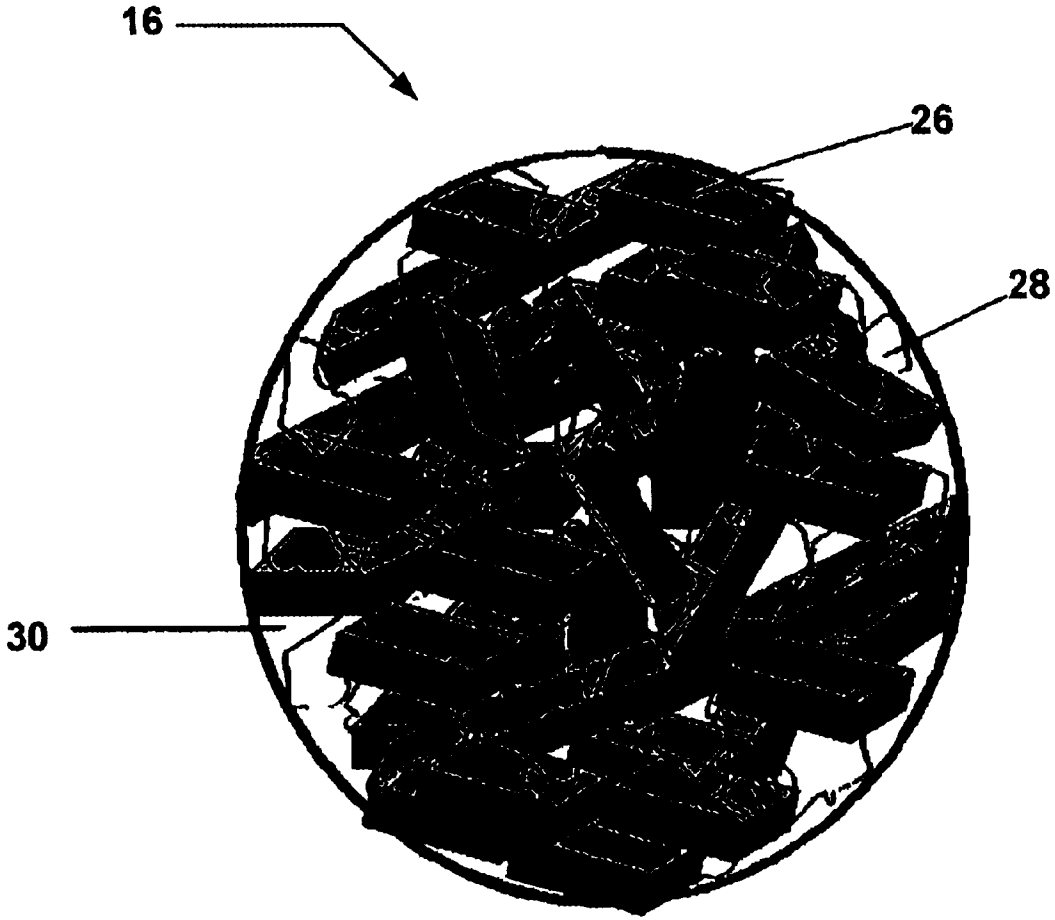
FIG. 4 is a detail view of the chunk plus hydrated super absorbent polymer (SAP) gel medium according to the present invention.

Referring now to FIG. 4, bullet trapping medium 16 includes a resilient granular ballistic medium 26, such as rubber chunks, wood chips, plastic scrap, or any other material that will not produce a ricochet when impacted by a bullet. Rubber chunks are preferred because of their durability when subjected to impacts from incoming bullets.

In embodiments, ballistic medium 26 is deposited directly onto upper surface 14 of support structure 12. However, ballistic medium 26 is preferably mixed with a hydrated super absorbent polymer (SAP) gel 28 to form an "artificial soil" of ballistic medium 26 "chunks" in an SAP gel 28 matrix. That is, ballistic medium 26 serves as a framework to hold hydrated SAP gel 28, and hydrated SAP gel 28 occupies interstices 30 within ballistic medium 26. This combination provides for a higher angle of repose $\alpha$ (shown in FIGS. 1 and 2), a reduced likelihood of sluffing of bullet trapping medium 16, and therefore the potential for a more compact backstop 10 in the direction of line of fire "a."

SAP will absorb up to 400 times its mass in water, such that the resulting hydrated SAP gel 28 can be up to 97.5% water by mass, with nearly the density of water. Thus, for bullet trapping backstops 10 maintained outside, rainfall enhances, rather than impairs, performance. SAP material is marketed in a variety of forms (e.g., granules, powders, and fibers). Preferably, hydrated SAP gel 28 is a sodium or potassium acrylate, acrylamide, or carboxylate polymer, or some combination thereof. Further, the mixture of ballistic medium 26 and SAP gel 28 may be more than 50% SAP by volume, such that there is a substantially reduced likelihood of fire, thereby reducing or eliminating the need for flame retardant additives.

Cross-linked polyacrylate and polyamide SAP gels 28 are most stable when maintained in a wet condition with a pH above 4.5, as they tend to shrink and shed water in acids. Additionally, higher alkalinities reduce the solubility of lead and other heavy metal ions. Thus, in embodiments, at least one additive is mixed with hydrated SAP gel 28 to maintain a pH of at least 4.5, and preferably a pH between 8 and 12, inclusive. The most preferred additives, as discussed below, typically provide a pH of approximately 10.4.

Further, SAP gel has an inherent ability to bind lead. For example, Cetco, Inc. of Arlington Heights, Ill. claims that a granular cross-linked polyacrylate will absorb a 30 ppm lead solution, producing a volume change of 110 times the volume of the absorbent. Since most of the lead in bullet backstop 10 will be in the form of metallic lead, however, it is also desirable to include at least one additive that will form a passive coating on the metallic particles, thereby preventing the lead from corroding, formulating soluble lead compounds, and leaching into the environment.

The preferred additives generally have low solubility in water, and will typically remain as powdery solids in the mixture. Appropriate choices are phosphates, carbonates, hydroxides, silicates, and bicarbonates, either singly or in combination. These additives can serve both purposes discussed above. That is, they will both increase the pH of SAP gel 28 and prevent leaching of heavy metals into the environment. They can also help stabilize hydrated SAP gel 28 chemically, retard the growth of mold or bacteria in hydrated SAP gel 28, and enhance the flame retardant characteristics of bullet trapping medium 16. One skilled in the art will understand how to select an appropriate cation, such as potassium, sodium, aluminum, magnesium, or calcium, for the additive. It will also be apparent to one skilled in the art that different or additional additives may be used as well. However, as will be discussed below, the most preferred additives are calcium phosphate, calcium carbonate, and aluminum hydroxide.

The use of buffering and passivating additives with SAP presents additional considerations. SAP absorbs less water per unit dry weight when the water around it contains large quantities of dissolved materials. For example, a typical SAP will absorb approximately 50 times its dry weight in water in a 1% NaCl solution, but only 22 times its dry weight in a 10% NaCl solution. Most buffering and passivating compounds are most effective when they are in solution in reasonably constant concentrations. Additionally, soluble forms of phosphorus can leach out of the SAP mixture, causing environmental pollution. Furthermore, any phosphate precipitated as lead or copper phosphate is no longer available to act as a buffer.

The present invention preferably addresses these considerations by using calcium phosphate compounds having low solubilities as additives. The concentration of these calcium compounds in solution is never high enough to alter the water absorbance of the SAP. However, as the phosphate is removed by reactions with lead and copper, more solid (particulate) calcium phosphate dissolves to maintain a saturated, but not very concentrated, solution. In addition to calcium phosphate compounds, calcium carbonate and aluminum hydroxide are valuable additives. Calcium carbonate provides additional buffering capacity, while aluminum hydroxide adds to the buffering capacity and can also react with lead phosphates to form very insoluble lead aluminum phosphates.

It will be apparent to one skilled in the art how to produce an SAP mixture with a pH in the desired range and saturated with respect to the additives used. One useful method of designing bullet trapping medium 16 is to estimate the volume of ballistic medium 26 to be employed in backstop 10 and determine the proportion of interstices 30 in that volume. Typically, this would be approximately 50% of the volume of ballistic medium 26. Assume that the density of hydrated SAP gel 28 needed to fill interstices 30 will approximate that of water and calculate the weight of hydrated SAP gel 28. Each additive can then be added to bullet trapping medium 16 as 5 to 10 parts of each additive for every 100 parts of hydrated SAP gel 28.

The resulting bullet trapping medium 16 reduces the leaching of heavy metals, thus prolonging the life of the trap. Since the trapped rounds are stabilized from an environmental perspective, there is also a substantially reduced need to periodically "clean" the trap and reclaim spent rounds. Furthermore, the medium is adapted for use with various calibers and metals, and provides for a nearly noiseless bullet impact. The medium may also be used to anchor disposable papier-mâché or cardboard targets, thus providing a stable and transportable target display without the use of items that will produce a ricochet or require retrieval and removal.

While the invention has been described in terms of its preferred embodiments, those skilled in the art will recognize that the invention can be practiced with modifications within the spirit and scope of the appended claims. Thus, it is intended that all matter contained in the foregoing description or shown in the accompanying drawings shall be interpreted as illustrative rather than limiting, and the invention should be defined only in accordance with the following claims and their equivalents.

What is claimed is:

1. A backstop for decelerating and trapping projectiles traveling along a line of fire, said backstop comprising:

a support structure having an upper surface, said upper surface having at least one segment inclined with respect to the line of fire; and a projectile trapping medium disposed on said upper surface, said projectile trapping medium comprising a mixture of a resilient granular ballistic medium in a hydrated super-absorbent polymer (SAP) gel matrix.

2. The backstop according to claim 1, wherein said support structure further comprises a back wall and two opposing sidewalls.

3. The backstop according to claim 2, wherein said support structure further comprises a toe block disposed adjacent a foot of said inclined segment.

4. The backstop according to claim 1, wherein said support structure further comprises a shock absorbing, foamed, fiber-reinforced concrete enclosure.

5. The backstop according to claim 4, wherein said shock absorbing, foamed, fiber-reinforced concrete is SACON®.

6. The backstop according to claim 1, wherein said ballistic medium is selected from the group consisting of rubber chunks, wood chips, plastic scraps, and any combination thereof.

7. The backstop according to claim 1, wherein said hydrated SAP gel is selected from the group consisting of sodium acrylate, potassium acrylate, sodium acrylamide, potassium acrylamide, sodium carboxylate, potassium carboxylate, and any combination thereof.

8. The backstop according to claim 1, wherein said projectile trapping medium further comprises at least one additive.

9. The backstop according to claim 8, wherein said at least one additive is selected from the group consisting of phosphates, carbonates, hydroxides, silicates, bicarbonates, and any combination thereof.

10. The backstop according to claim 8, wherein said at least one additive serves to maintain a pH of said hydrated SAP gel at 4.5 or higher.

11. The backstop according to claim 10, wherein the pH of said hydrated SAP gel is between 8 and 12, inclusive.

12. The backstop according to claim 8, wherein said at least one additive serves to inhibit leaching of heavy metals that may be contained within the projectiles.

13. The backstop according to claim 1, wherein said inclined segment is inclined with respect to the line of fire by an angle less than or equal to an angle of repose of the projectile trapping medium.

14. A method of forming a backstop for decelerating and trapping projectiles traveling along a line of fire, comprising the steps of:

providing a support structure having an inclined surface;

mixing a resilient granular ballistic medium with a hydrated super absorbent polymer (SAP) gel, thereby forming a projectile trapping medium comprising a mixture of a resilient granular ballistic medium in a hydrated super-absorbent polymer (SAP) gel matrix; and disposing said projectile trapping medium on the inclined surface.

15. The method according to claim 14, further comprising the step of adding to the projectile trapping medium at least one additive selected from the group consisting of additives serving to increase a pH of the hydrated SAP gel, additives serving to prevent leaching of heavy metals that may be contained within the projectiles, and flame retardant additives.

16. The method according to claim 14, wherein said step of providing a support structure comprises providing a shock absorbing, foamed, fiber-reinforced concrete support structure.

17. The method according to claim 14, further comprising the step of maintaining a pH of the hydrated SAP gel at a value of at least 4.5.

18. The method according to claim 17, wherein said step of maintaining a pH of the hydrated SAP gel at a value of at least 4.5 comprises maintaining the pH of the hydrated SAP gel at a value between 8 and 12, inclusive.

* * * * *